US009339167B2

(12) United States Patent
Kim et al.

(10) Patent No.: US 9,339,167 B2
(45) Date of Patent: May 17, 2016

(54) DISHWASHER

(75) Inventors: Minchul Kim, Seoul (KR); Ganghyun Lee, Seoul (KR); Nungseo Park, Seoul (KR); Kyungrae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1225 days.

(21) Appl. No.: 13/215,327

(22) Filed: Aug. 23, 2011

(65) Prior Publication Data

US 2012/0055518 A1 Mar. 8, 2012

(30) Foreign Application Priority Data

Sep. 2, 2010 (KR) ..... 10-2010-0086014
Sep. 2, 2010 (KR) ..... 10-2010-0086016
Sep. 2, 2010 (KR) ..... 10-2010-0086020

(51) Int. Cl.

| | |
|---|---|
| ***A47L 15/02*** | (2006.01) |
| ***B08B 13/00*** | (2006.01) |
| ***B08B 3/00*** | (2006.01) |
| ***A47L 15/42*** | (2006.01) |

(52) U.S. Cl.

CPC ..... *A47L 15/4225* (2013.01); *A47L 15/4204* (2013.01); *A47L 15/4206* (2013.01); *A47L 15/4221* (2013.01); *A47L 15/4274* (2013.01); *A47L 15/4285* (2013.01); *A47L 15/4214* (2013.01)

(58) Field of Classification Search

CPC combination set(s) only.
See application file for complete search history.

(56) References Cited

U.S. PATENT DOCUMENTS

| | | | | |
|---|---|---|---|---|
| 2006/0060224 | A1* | 3/2006 | Yoon et al. | 134/56 D |
| 2006/0180185 | A1* | 8/2006 | Jeong et al. | 134/58 D |
| 2006/0207632 | A1* | 9/2006 | Lee | 134/25.2 |
| 2007/0006898 | A1* | 1/2007 | Lee | 134/10 |
| 2007/0006901 | A1* | 1/2007 | Cho et al. | 134/25.2 |
| 2008/0163903 | A1 | 7/2008 | Bang | |
| 2009/0095333 | A1* | 4/2009 | Lim | 134/105 |

FOREIGN PATENT DOCUMENTS

| | | | |
|---|---|---|---|
| CN | 201290659 | Y | 8/2009 |
| EP | 0 774 230 | B1 | 9/2001 |
| EP | 1 256 308 | B1 | 8/2004 |
| EP | 1 602 316 | A2 | 12/2005 |
| JP | 9-154795 | A | 6/1997 |
| JP | 2007-105210 | A | 4/2007 |
| KR | 10-2006-0060123 | A | 6/2006 |
| KR | 10-2006-0106027 | A | 10/2006 |

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

Provided is a dishwasher, which includes a washing chamber, a sump, and a washing water pump. The washing chamber accommodates a dish. The sump stores washing water supplied to the washing chamber. The washing water pump is provided to the sump and generates suction force for circulating washing water. The washing water pump includes a washing water motor for generating driving force, an impeller part disposed under the washing water motor and rotated by the driving force, and a heating space under the impeller part. Washing water is heated by a heater in the heating space.

26 Claims, 16 Drawing Sheets

DISHWASHER

CROSS-REFERENCE TO RELATED APPLICATIONS

The present application claims priority under 35 U.S.C. 119 and 35 U.S.C. 365 to Korean Patent Application No. 10-2010-0086014, 10-2010-0086016 and 10-2010-0086020 filed on Sep. 2, 2010 which is hereby incorporated by reference in its entirety.

BACKGROUND

The present disclosure relates to a dishwasher.

Dishwashers spray washing water to a dish to remove leftover food or food waste from the dish.

Such a dishwasher includes a sump at a side of a washing chamber to receive clean washing water, and a washing water sprayer to spray washing water to dishes within the washing chamber, thereby washing the dishes. The washing water used for washing the dishes is recovered to the sump, and then, is supplied again to the washing water sprayer through a filter device within the sump.

When the washing of the dishes is completed, all of the washing water is discharged from the washing chamber and the sump. At this point, a foreign substance filtered by the filter device may be discharged together with the washing water out of the dishwasher.

The sump may be provided with a washing water pump for moving washing water to the washing chamber. The washing water pump may include a washing water motor and an impeller part.

The volume of the sump may be increased according to an arrangement of the washing water motor and the impeller part. Particularly, the height of the sump may be increased.

As the volume of the sump increases, the length of a passage for washing water flowing within the sump, and the amount of the washing water are increased. As a result, power consumption (energy) for circulating a large amount of washing water is increased.

Moreover, material costs for manufacturing the sump having a large volume are increased, and its manufacturing process is complicated.

The washing chamber is provided with spraying nozzles for spraying washing water to a dish. The spraying nozzles may be disposed at different positions.

The sump is provided with an opening-closing member that controls passages to supply washing water to at least one of the spraying nozzles. The opening-closing member may be provided with a driving part.

While washing water flows through the opening-closing member, a foreign substance included in the washing water may negatively affect an operation of the opening-closing member. That is, when a foreign substance is trapped in the opening-closing member, an operation of the opening-closing member may be limited, and thus, a passage control may be limited. As a result, washing efficiency of the dishwasher may be degraded.

In addition, an interference between a foreign substance and the opening-closing member may make noise and damage the opening-closing member. A portion of washing water passing through the opening-closing member may leak, and be introduced to the driving part, thereby damaging the driving part.

The filter device may include filter members. As an operation time of the dishwasher increases, the amount of a foreign substance trapped in the filter device also increases. Thus, when an operation time of the dishwasher is over a predetermined time, the filter device should be disassembled and cleaned.

After the cleaning, when the filter device is assembled, coupling of the filter members constituting the filter device may be difficult. For example, when coupling of the filter members is limited to a single direction, the coupling of the filter members may be difficult.

Particularly, since the filter members continually filter a foreign substance, the filter members may be unsanitary. Thus, when coupling of the unsanitary filter members is difficult, a user who couples the unsanitary filter members may be displeased. As a result, customer satisfaction may be decreased.

SUMMARY

Embodiments provide a dishwasher that decreases the volume or height of a sump, thereby decreasing the amount of washing water.

Embodiments also provide a dishwasher that prevents contamination of a passage opening-closing part due to a foreign substance, thereby facilitating a control of passages for washing water.

Embodiments also provide a dishwasher that facilitates assembly of a filter assembly.

In one embodiment, a dishwasher includes: a washing chamber accommodating a dish; a sump for storing washing water supplied to the washing chamber; and a washing water pump provided to the sump and generating suction force for circulating washing water, wherein the washing water pump includes: a washing water motor for generating driving force; an impeller part disposed under the washing water motor and rotated by the driving force; and a heating space under the impeller part, wherein washing water is heated by a heater in the heating space.

In another embodiment, a dishwasher includes: a washing chamber accommodating a dish; a sump for storing washing water supplied to the washing chamber; and a washing water pump provided to the sump and generating suction force for circulating washing water, wherein the washing water pump includes: a washing water motor through which a motor shaft passes; a shaft housing accommodating at least one portion of the motor shaft; an impeller part rotatably coupled to a lower end of the shaft housing; and a heating space disposed under the impeller part, and provided with a heater.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
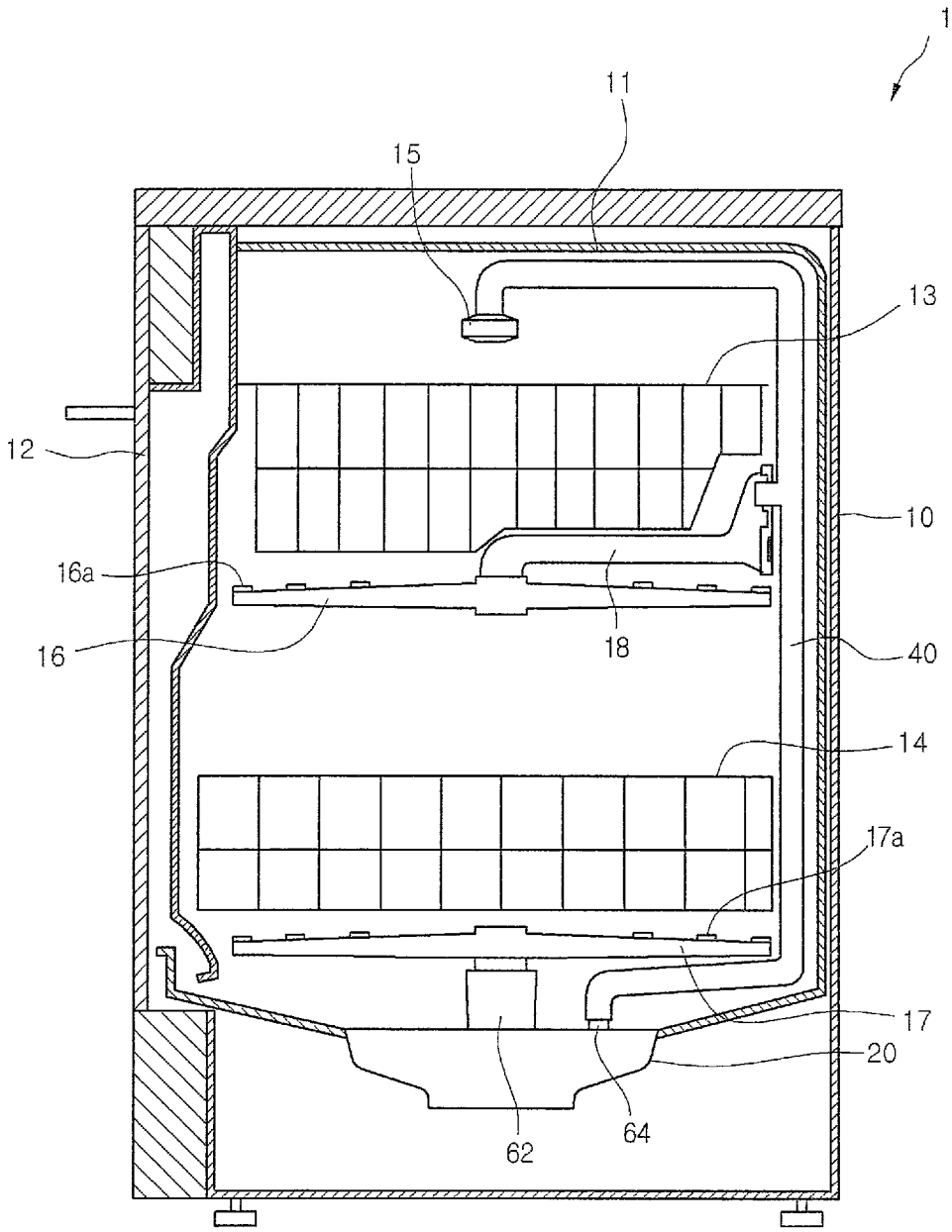
FIG. 1 is a cross-sectional view illustrating a dishwasher according to a first embodiment.

FIG. 1 is a cross-sectional view illustrating a dishwasher according to a first embodiment.

Referring to FIG. 1, a dishwasher 1 according to the first embodiment includes: a case 10 forming an appearance of the dishwasher 1; a tub 11 disposed in the case 10 to form a washing chamber; a door 12 provided to the front surface of the tub 11 to open and close the washing chamber; and a sump 20 disposed under the tub 11 to store washing water.

An upper rack 13 and a lower rack 14, which accommodate dishes, are disposed in the tub 11. The upper rack 13 is spaced a predetermined distance upward from the lower rack 14. The upper rack 13 and the lower rack 14 are guided by guide rails (not shown) disposed on inner surfaces of the tub 11, so that the upper rack 13 and the lower rack 14 can be drawn to the front side from the tub 11.

A top nozzle 15, an upper nozzle 16, and a lower nozzle 17 are disposed over the sump 20 to spray washing water from the sump 20 into the washing chamber.

In detail, the lower nozzle 17 is coupled to the top surface of the sump 20 to spray washing water to the lower portion of the washing chamber, and the sprayed washing water is directed to a dish in the lower rack 14. The sump 20 is provided with a lower nozzle coupling part 62 coupled to the lower nozzle 17. The lower nozzle 17 includes lower spraying holes 17*a* to spray washing water. The lower spraying holes 17*a* may be disposed at both sides of the lower nozzle coupling part 62.

The upper nozzle 16 is disposed in the middle of the washing chamber to spray washing water to the upper rack 13. The top nozzle 15 is disposed at a ceiling of the tub 11 to spray washing water downward.

A nozzle holder 18 is disposed between the upper nozzle 16 and a washing water guide 40. The nozzle holder 18 extends from the washing water guide 40 to the center of the tub 11, and is coupled approximately to the center of the upper nozzle 16. The upper nozzle 16 includes upper spraying holes 16*a* to spray washing water. The upper spraying holes 17*a* may be disposed at both sides of a portion of the upper nozzle 16 coupled to the nozzle holder 18.

The washing water guide 40 is disposed over the sump 20 to guide washing water from a washing water pump. The washing water guided through the washing water guide 40 may be sprayed to the upper rack 13 through the top nozzle 15 or the upper nozzle 16. The sump 20 is provided with a guide connection 64 coupled to the washing water guide 40.

Figure 2:
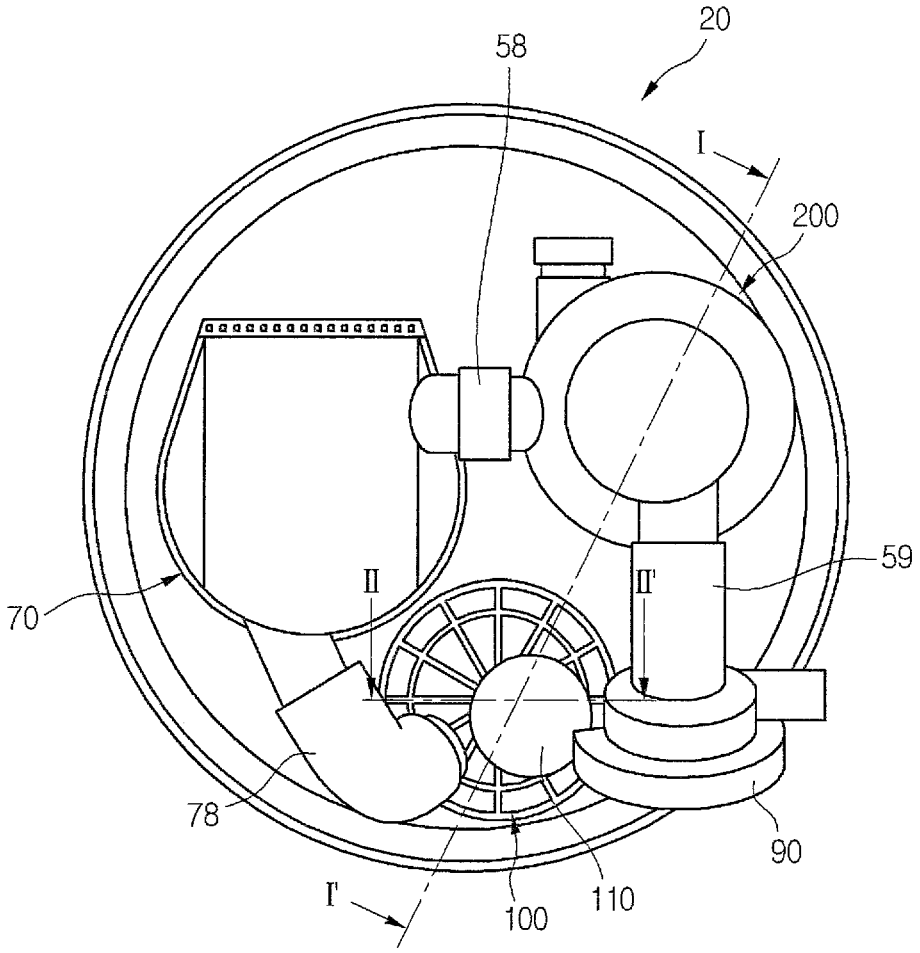
FIG. 2 is a bottom view illustrating a sump according to the first embodiment.
Figure 3:
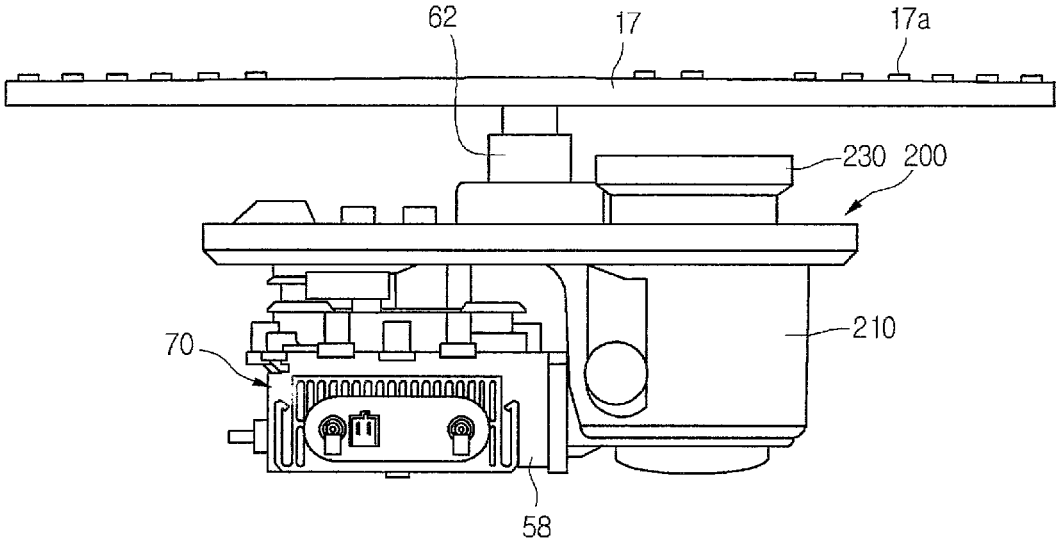
FIG. 3 is a side view illustrating the sump according to the first embodiment.
Figure 4:
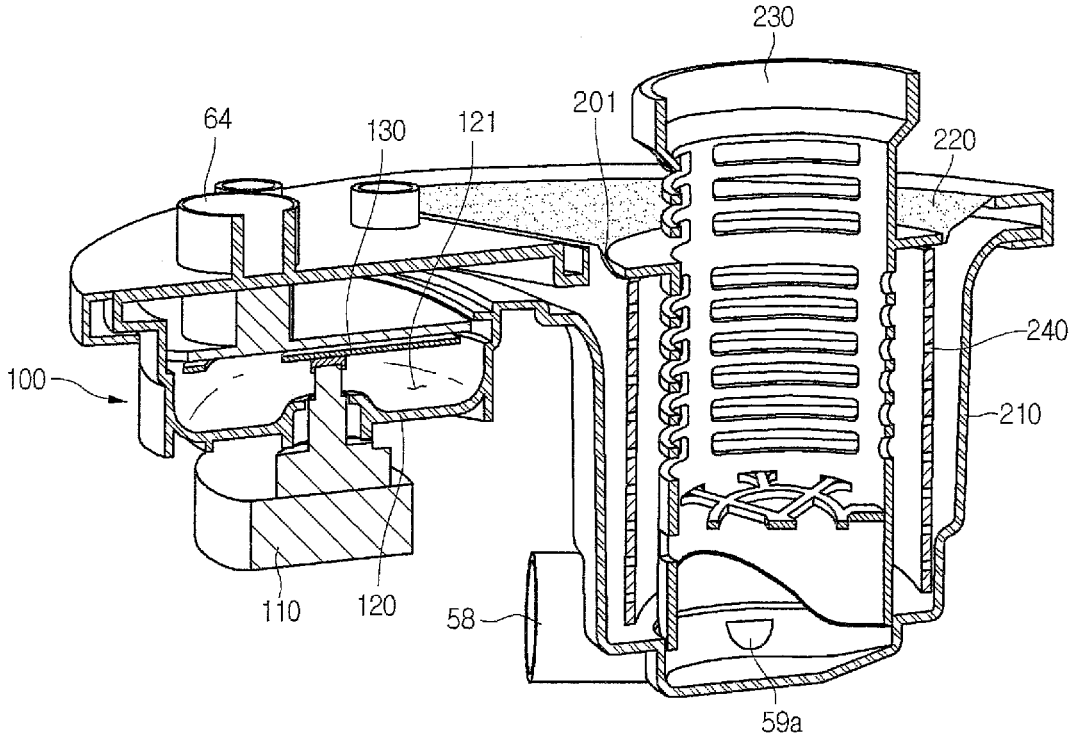
FIG. 4 is a cut-away perspective view taken along line I-I' of FIG. 2.

FIG. 2 is a bottom view illustrating a sump according to the first embodiment. FIG. 3 is a side view illustrating the sump according to the first embodiment. FIG. 4 is a cut-away perspective view taken along line I-I' of FIG. 2.

Referring to FIGS. 2 to 4, the sump 20 includes: a filter part 200 filtering a foreign substance from washing water after washing a dish in the tub 11; a washing water pump 70 pumping the washing water from the filter part 200; and a passage opening-closing part 100 switching or opening-closing passages to move the washing water from the washing water pump 70 to the lower nozzle 17 or the washing water guide 40.

In detail, the filter part 200 includes: a first filter 220 constituting a lower end of a washing space of the tub 11 and including holes having a first size; a second filter 230 disposed in the sump 20 and including holes having a size greater than the first size; and a third filter 240 disposed in the sump 20 and including holes having a size smaller than the first size. The first filter 220 is provided to a portion of the top surface of the sump 20.

Further, the filter part 200 includes a filter housing 210 accommodating the second and third filters 230 and 240. A filter introduction part 201 is disposed over the filter housing 210 to introduce washing water to the filter part 200. The second and third filters 230 and 240 filter a foreign substance from washing water introduced into the filter housing 210 through the filter introduction part 201.

A pump introduction part 58 is disposed at a side of the lower portion of the filter housing 210 to introduce purified washing water to the washing water pump 70. Washing water stored in the sump 20 may be moved through the filter part 200 to the pump introduction part 58 by suction force of the washing water pump 70.

A pump discharge part 78 is disposed at a side of the washing water pump 70 to discharge washing water from the washing water pump 70. Washing water is introduced to the washing water pump 70 through the pump introduction part 58, and is discharged from the washing water pump 70 through the pump discharge part 78.

The pump discharge part 78 is connected to the passage opening-closing part 100. The passage opening-closing part 100 includes: an opening-closing valve 130 opening and closing the passages for washing water; and an opening-closing driving part 110 driving the opening-closing valve 130. Washing water introduced to the passage opening-closing part 100 may be moved through the opening-closing valve 130 to the lower nozzle coupling part 62 or the guide connection 64.

That is, washing water may be moved to the lower nozzle coupling part 62 by an operation of the opening-closing valve 130, so that the washing water can be moved to the lower nozzle 17. On the contrary, washing water to be moved to the upper nozzle 16 or the top nozzle 15 may be moved to the guide connection 64.

The washing water guide 40 may include passages communicating with the top nozzle 15 or the upper nozzle 16, that is, a top nozzle passage (not shown) and an upper nozzle passage (not shown). Washing water may be moved to the top nozzle passage and the upper nozzle passage by controlling the opening-closing valve 130.

The top nozzle 15, the upper nozzle 16, and the lower nozzle 17 may be selectively opened to spray washing water through one of the top nozzle 15, the upper nozzle 16, and the lower nozzle 17. Alternatively, all of the top nozzle 15, the upper nozzle 16, and the lower nozzle 17 are opened to spray washing water through all of the top nozzle 15, the upper nozzle 16, and the lower nozzle 17.

A discharging pump 90 providing suction force for discharging washing water, and a discharging part 59 disposed between the filter part 200 and the discharging pump 90 to discharge washing water and a foreign substance are disposed at a side of the filter part 200. A discharging hole 59*a* for discharging washing water is disposed in the lower portion of the filter housing 210.

When the discharging pump 90 is driven, washing water stored in the sump 20 and a foreign substance remaining in the filter part 200 are discharged through the discharging hole 59*a*. The washing water discharged through the discharging hole 59*a* may be discharged out of the dishwasher 1 through the discharging part 59 and the discharging pump 90.

The passage opening-closing part 100 includes a case 120 storing washing water introduced through the washing water pump 70. The case 120 defines a washing water storage 121 for storing washing water.

Operations of a dishwasher configured as described above will now be described.

The dishwasher 1 may perform a preliminary washing process, a main washing process, a rinsing process, a hot rinsing process, a drying process.

The preliminary washing process is a process of removing a protein-based waste before the main washing process. The main washing process uses heated washing water and a detergent. The rinsing processes including the hot rinsing process are processes of removing leftovers or a detergent from a dish. Washing water may be supplied and discharged between the preliminary washing process and the main washing process, between the main washing process and the rinsing process, and between the rinsing process and the hot rinsing process.

Supplied washing water is stored in the sump 20. Then, when the washing water pump 70 is driven, the washing water may be simultaneously or selectively sprayed to the top nozzle 15, the upper nozzle 16, and the lower nozzle 17 through the washing water pump 70 and the passage opening-closing part 100.

The sprayed washing water washes dishes in the upper rack 13 and the lower rack 14, is stored again in the sump 20, and is moved to the filter part 200 by the suction force of the washing water pump 70 to filter a foreign surface. Then, the washing water purified by the filtering may be sprayed again into the washing chamber of the tub 11 through the washing water pump and the passage opening-closing part 100. This washing procedure may be repeated several times.

Figure 5:
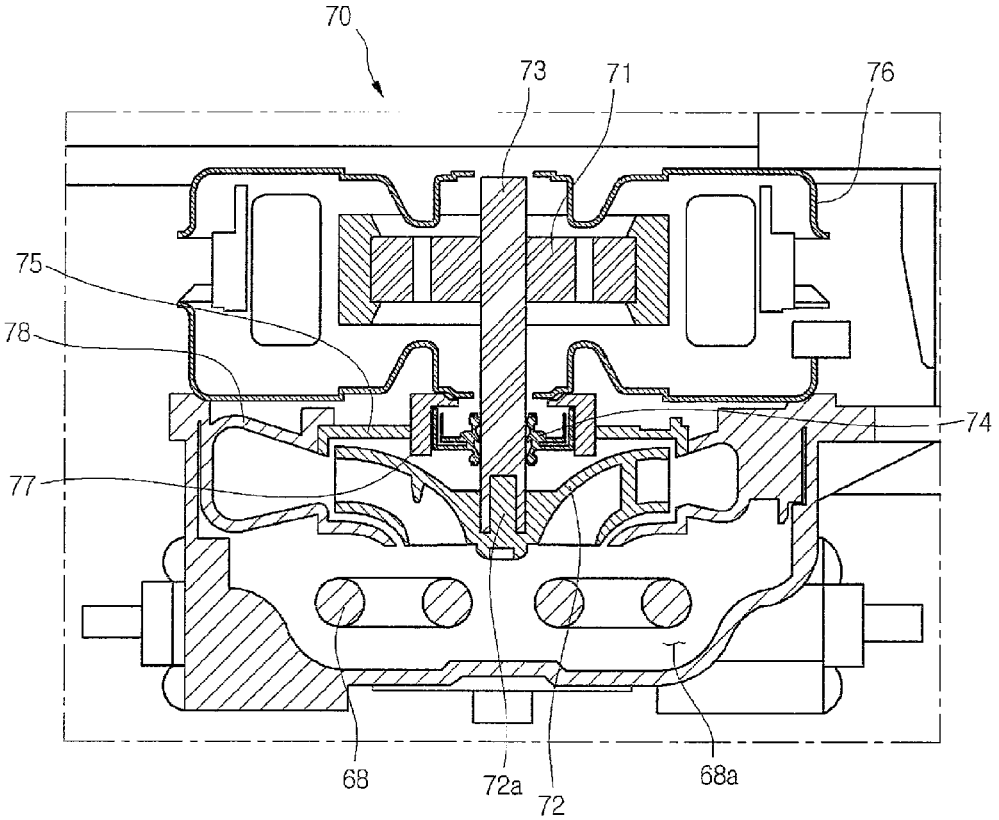
FIG. 5 is a cross-sectional view illustrating a washing water pump according to the first embodiment.
Figure 6:
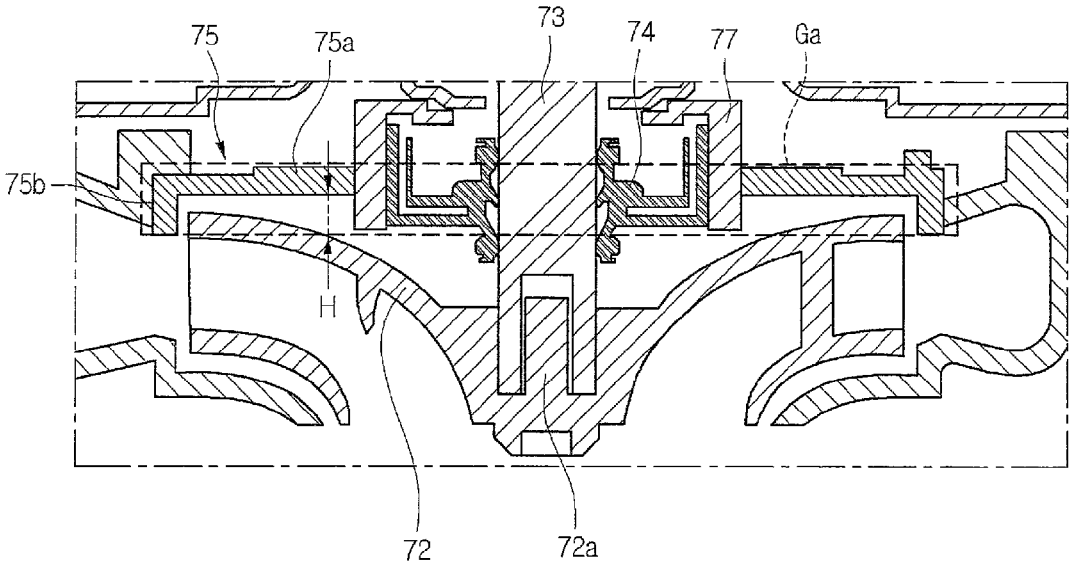
FIG. 6 is a cross-sectional view illustrating a portion of the washing water pump according to the first embodiment.

FIG. 5 is a cross-sectional view illustrating a washing water pump according to the first embodiment. FIG. 6 is a cross-sectional view illustrating a portion of the washing water pump according to the first embodiment.

Referring to FIGS. 5 and 6, the washing water pump 70 includes a washing water motor 71 for generating driving force, and an impeller part 72 disposed under the washing water motor 71 and rotatable by the driving force of the washing water motor 71.

The washing water motor 71 is disposed under the top of the sump 20, and is accommodated in a motor case 76. The top of the motor case 76 may contact the bottom surface of the top of the sump 20.

A motor shaft 73 rotated by the driving force of the washing water motor 71 is disposed in the washing water motor 71. The motor shaft 73 passes through the washing water motor 71, and extends downward from the washing water motor 71.

The impeller part 72 is coupled to the lower end of the motor shaft 73. A shaft coupling part 72*a* coupled to the motor shaft 73 is disposed approximately at the center of the impeller part 72.

A shaft housing 77 is disposed outside the motor shaft 73 to accommodate at least one portion of the motor shaft 73. The shaft housing 77 may be disposed between the washing water motor 71 and the impeller part 72.

The outer circumferential surface of the motor shaft 73 is spaced apart from an inner surface of the shaft housing 77. A sealing member 74 for preventing the introduction of washing water to the washing water motor 71 is disposed between the outer circumferential surface of the motor shaft 73 and an inner circumferential surface of the shaft housing 77. The sealing member 74 is disposed at a position corresponding to the lower end of the shaft housing 77, and extends from the outer circumferential surface of the motor shaft 73 to the inner circumferential surface of the shaft housing 77.

An opening of the lower end of the shaft housing 77 may be closed by the sealing member 74. Thus, washing water can be prevented from being introduced to the shaft housing 77 while the impeller part 72 rotates.

The upper end of the shaft housing 77 may be disposed at a position corresponding to the lower end of the motor case 76. For example, the upper end of the shaft housing 77 may contact the lower end of the motor case 76.

That is, the shaft housing 77 is not spaced apart from the motor case 76, and the motor shaft 73 is disposed within the motor case 76 and the shaft housing 77. As a result, the motor shaft 73 is not exposed out of the sump 20, and does not affect the height of the sump 20.

An impeller case 75 is disposed outside the shaft housing 77 to cover the upper portion of the impeller part 72. The impeller case 75 extends to both sides from the shaft housing 77. A lateral length of the shaft housing 77 and the impeller case 75 may correspond to a lateral length of the impeller part 72.

As a result, the shaft housing 77 and the impeller case 75 are disposed between the impeller part 72 and the washing water motor 71 to function as a cover member that covers the upper portion of the impeller part 72 to limit the upward movement of washing water. The lower end of the shaft housing 77 is approximately the same in height as the upper end of the impeller part 72.

The pump discharge part 78 for moving washing water passing through the impeller part 72 is disposed at a side of the impeller part 72. The washing water may be discharged out of the washing water pump 70 through the pump discharge part 78. The pump discharge part 78 extends outward from the impeller case 75. The pump discharge part 78 may be integrally formed with the impeller case 75.

A heater 68 may be disposed under the impeller part 72 to heat flowing washing water. The heater 68 is disposed in the lower space of the washing water pump 70, and is located at a height to correspond to the pump introduction part 58. Thus, washing water introduced to the washing water pump 70 can be quickly heated by the heater 68. A heating space 68*a* is defined as the lower space of the washing water pump 70 in which washing water is heated by the heater 68. Since washing water for washing a dish is heated to high temperature by the heater 68, washing efficiency is improved.

The inner height of the washing water pump 70 is determined by the sum of the heights of the motor case 76, the shaft housing 77, and the impeller part 72, and the heating space 68*a*. In detail, the washing water motor 71 is connected directly to the impeller part 72 through the motor shaft 73, and the motor case 76 is not spaced apart from the shaft housing 77.

Since the lower end of the shaft housing 77 corresponds to the upper end of the impeller part 72, the height of the sump 20 may be determined by components of the washing water pump 70, that is, by the washing water motor 71, the impeller part 72, and the heating space 68*a*. As a result, since a separate component is not disposed between the washing water motor 71 and the impeller part 72, the height and volume of the sump 20 can be decreased.

Accordingly, the amount of washing water introduced to the sump 20 is decreased, and power consumption (energy) for circulating washing water can be deceased.

The impeller case 75 includes an extension 75*a*, which is higher than the lower end of the shaft housing 77, and which laterally extends from the outer circumferential surface of the shaft housing 77. The lower end of the shaft housing 77 may be spaced apart from the extension 75*a* by a distance H.

The impeller case 75 includes a bent portion 75*b* that extends downward from an end of the extension 75*a*.

An air gap Ga is disposed between the impeller part 72 and the impeller case 75 to accommodate air. In detail, the air gap Ga is a space disposed over the impeller part 72, and is closed by the impeller case 75 and the shaft housing 77.

In other words, the air gap Ga may be a space defined by the impeller part 72, the impeller case 75, and the shaft housing 77.

The air gap Ga may include spaces at both sides of the shaft housing 77. Washing water may be rotated under the air gap Ga, and be discharged to the pump discharge part 78.

As a result, while washing water flows through the impeller part 72, contact of the washing water with the shaft housing 77 and the sealing member 74 around the air gap Ga is limited. Accordingly, the shaft housing 77 and the sealing member 74 are protected from washing water.

Especially, when washing water is hard water, the washing water contains calcium. When hard water contacts the shaft housing 77 or the sealing member 74, the shaft housing 77 or the sealing member 74 may be contaminated or corroded. However, in the current embodiment, since washing water is prevented from contacting the shaft housing 77 or the sealing member 74, the shaft housing 77 and the sealing member 74 are protected from washing water.

Figure 7:
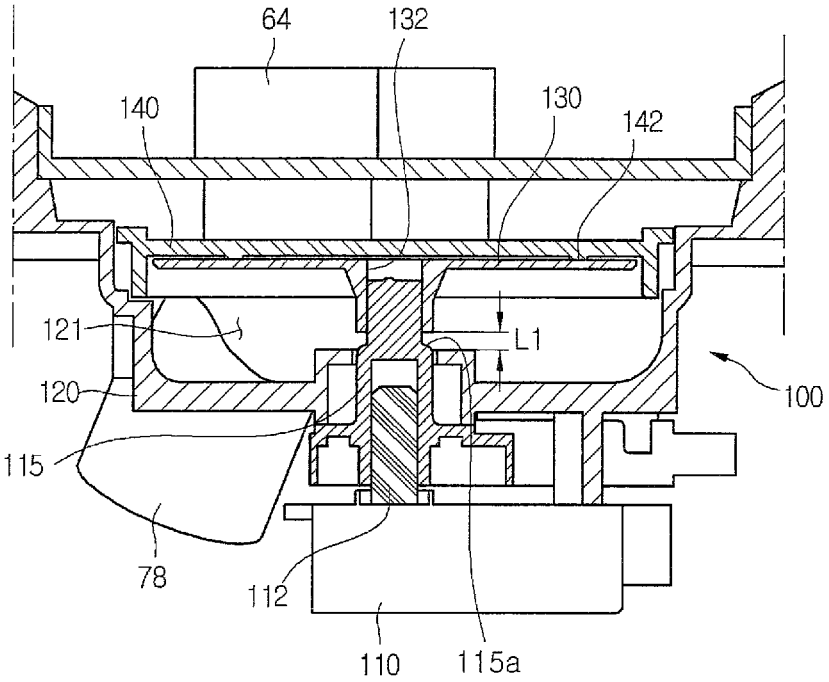
FIG. 7 is a cross-sectional view taken along line II-II' of FIG. 2.
Figure 8:
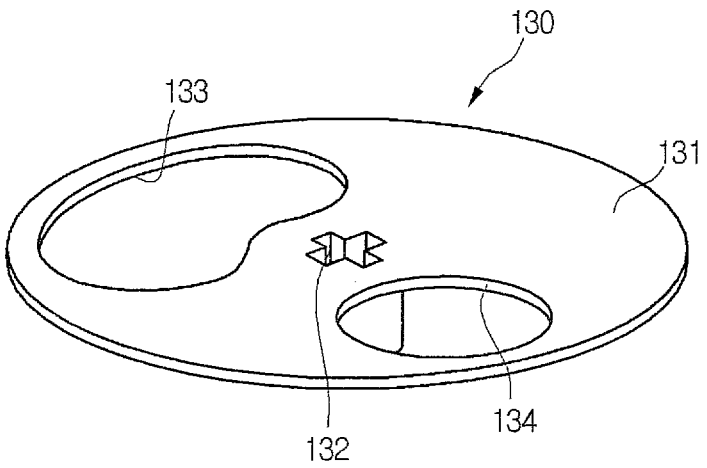
FIG. 8 is a perspective view illustrating an opening-closing valve according to a second embodiment.
Figure 9:
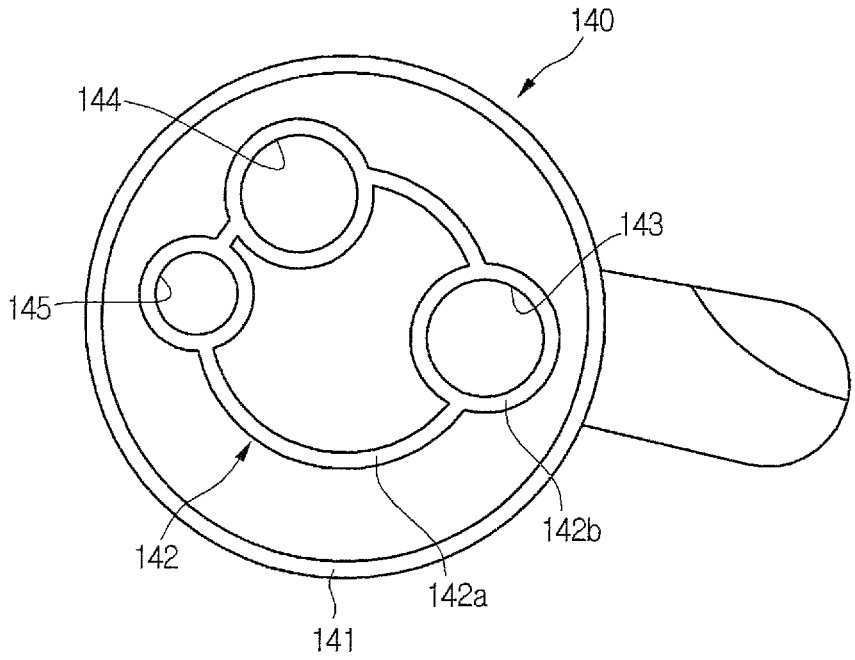
FIG. 9 is a schematic view illustrating a valve case according to the second embodiment.
Figure 10:
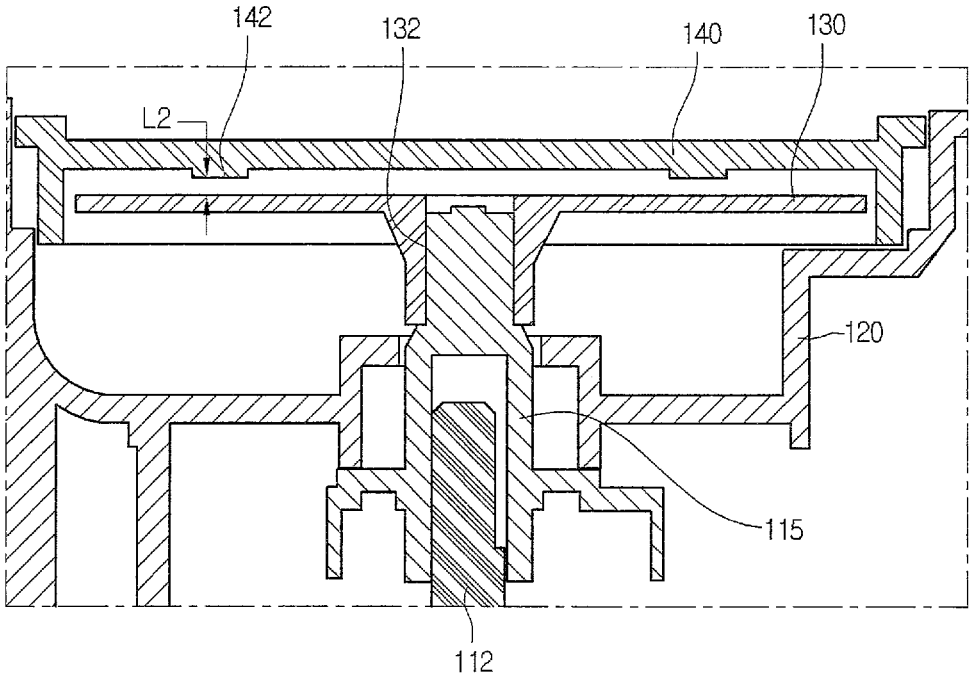
FIG. 10 is a cross-sectional view illustrating the opening-closing valve moved downward, according to the second embodiment.

FIG. 7 is a cross-sectional view taken along line II-II' of FIG. 2. FIG. 8 is a perspective view illustrating an opening-closing valve according to a second embodiment. FIG. 9 is a schematic view illustrating a valve case according to the second embodiment. FIG. 10 is a cross-sectional view illustrating the opening-closing valve moved downward, according to the second embodiment.

Referring to FIGS. 7 to 10, according to the second embodiment, the passage opening-closing part 100 includes the opening-closing driving part 110 for generating driving force, the case 120 (also called storage case) storing washing water introduced through the pump discharge part 78, the opening-closing valve 130 movable at the upper side of the storage case 120, and a valve case 140 closing the upper side of the opening-closing valve 130. A space formed by the storage case 120 and the valve case 140 may be defined as the washing water storage 121 in which washing water is stored.

The opening-closing driving part 110 is coupled to the opening-closing valve 130 through a driving shaft 112 and a shaft connection 115. In detail, the driving shaft 112 extends upward from the opening-closing driving part 110, and couples to the shaft connection 115. The shaft connection 115 has a lower opening, and the driving shaft 112 is inserted in the lower opening of the shaft connection 115.

The shaft connection 115 extends upward, and couples to the lower portion of the opening-closing valve 130. The shaft connection 115 transmits torque from the driving shaft 112 to the opening-closing valve 130. The shaft connection 115 passes through the bottom of the storage case 120.

The opening-closing valve 130 may be rotated by the driving force of the opening-closing driving part 110. The opening-closing valve 130 includes a valve main body 131 and a plurality of valve holes 133 and 134 passing through the valve main body 131.

The valve main body 131 has an approximately circular plate shape, and functions as a cover to limit a flow of washing water. Washing water may flow through at least one of the valve holes 133 and 134. That is, the valve holes 133 and 134 function as portions of passages for washing water.

The valve holes 133 and 134 include a first valve hole (also denoted by 133) and a second valve hole (also denoted by 134) spaced apart from the first valve hole 133. The first valve hole 133 may be different in size from the second valve hole 134.

The opening-closing valve 130 includes an insertion part 132 in which the shaft connection 115 is inserted. The insertion part 132 may be defined as a space passing downward through at least one portion of the valve main body 131. The insertion part 132 may be coupled to the upper portion of the shaft connection 115.

The valve case 140 includes a case main body 141 corresponding to the opening-closing valve 130 and having an approximately circular plate shape, and a plurality of case holes 143, 144, and 145 formed by at least partially opening the case main body 141.

The case holes 143, 144, and 145 include a first case hole (also denoted by 143), a second case hole (also denoted by 144), and a third case hole (also denoted by 145), which are spaced apart from one another. The first, second, and third case holes 143, 144, and 145 are disposed at positions to correspond to the valve holes 133 and 134 of the opening-closing valve 130.

For example, while the opening-closing valve 130 rotates, the first valve hole 133 may communicate with the first case hole 143, and the second valve hole 134 may communicate with at least one of the second and third case holes 144 and 145. While the first valve hole 133 may communicate with the first case hole 143, the second valve hole 134 may be closed by the case main body 141.

According to a rotation position of the opening-closing valve 130, the first valve hole 133 may communicate with the second and third case holes 144 and 145, the second valve hole 134 may communicate with the first case hole 143. That is, the first valve hole 133 may have a size corresponding to the sum of the sizes of the second and third case holes 144 and 145 to simultaneously communicate with the second and third case holes 144 and 145.

As such, a valve hole and a case hole, which communicate with each other, may be determined according to a rotation position of the opening-closing valve 130. Accordingly, a nozzle receiving washing water, that is, one of the lower nozzle 17, the upper nozzle 16, and the top nozzle 15 may be selected.

The case main body 141 includes a contact rib 142 that can contact the valve main body 131. The contact rib 142 may be defined as a region that the opening-closing valve 130 contacts.

The contact rib 142 includes a first rib 142*a* having a circle shape corresponding to a radius of gyration of the opening-closing valve 130, and a plurality of second ribs 142*b* extending along the circumferences of the case holes 143, 144, and 145. The first and second ribs 142*a* and 142*b* may protrude a predetermined height from the case main body 141.

The top surface of the valve main body 131 may (closely) contact the contact rib 142. That is, among the total area of the valve main body 131, the portion corresponding to the contact rib 142 contacts the case main body 141.

As such, since the valve main body 131 does not totally contact the valve case 140, frictional force between the opening-closing valve 130 and the valve case 140 is decreased. As a result, the opening-closing valve 130 can efficiently rotate, closely contacting the valve case 140.

The opening-closing valve 130 may vertically move. In detail, the insertion part 132 of the opening-closing valve 130 may vertically move, connecting to the shaft connection 115.

The shaft connection 115 includes a stepped part 115*a* to limit a downward movement of the insertion part 132. The outer diameter of the lower portion of the shaft connection 115 with respect to the stepped part 115*a* is greater than that of the upper portion thereof. When the insertion part 132 is supported by, that is, is hung on the upper portion of the stepped part 115*a*, a downward movement of the insertion part 132 or the opening-closing valve 130 is limited.

A traveling distance of the insertion part 132 or the opening-closing valve 130 may be a distance between a (first) position where the opening-closing valve 130 contacts the valve case 140 and a (second) position where the insertion part 132 is supported by the stepped part 115*a*.

When the opening-closing valve 130 is disposed at the first position, washing water may be considered to be moved by the suction force of the washing water pump 70. In detail, the opening-closing valve 130 closely contacts the valve case 140 by the pressure of washing water introduced through the pump discharge part 78. A distance L1 between the lower end of the insertion part 132 and the stepped part 115*a* is illustrated in FIG. 7.

The valve main body 131 may contact the contact rib 142, and washing water may flow to the lower nozzle 17 or the washing water guide 40 through a valve hole and a case hole communicating with the valve hole.

On the contrary, when the opening-closing valve 130 is disposed at the second position, the washing water pump 70 may be considered to be turned off, and washing water may be considered to be immobilized. At this point, since the pressure of the washing water is not applied to the opening-closing valve 130, the opening-closing valve 130 may be moved downward by gravity. A distance L2 between the top surface of the valve main body 131 and the contact rib 142 is illustrated in FIG. 10. The distance L2 may be equal to the distance L1.

As such, when washing water is not moved within the passage opening-closing part 100, since the opening-closing valve 130 and the valve case 140 are spaced apart from each other, a possibility that a foreign substance is continually trapped between the opening-closing valve 130 and the valve case 140 is reduced.

When washing water flows within the passage opening-closing part 100, the washing water and a foreign substance disposed between the opening-closing valve 130 and the valve case 140 may be moved to the lower nozzle 17 or the washing water guide 40. As a result, a foreign substance is prevented from being trapped between the opening-closing valve 130 and the valve case 140, so as to prevent a noise or protect the configuration of the passage opening-closing part 100.

Figure 11:
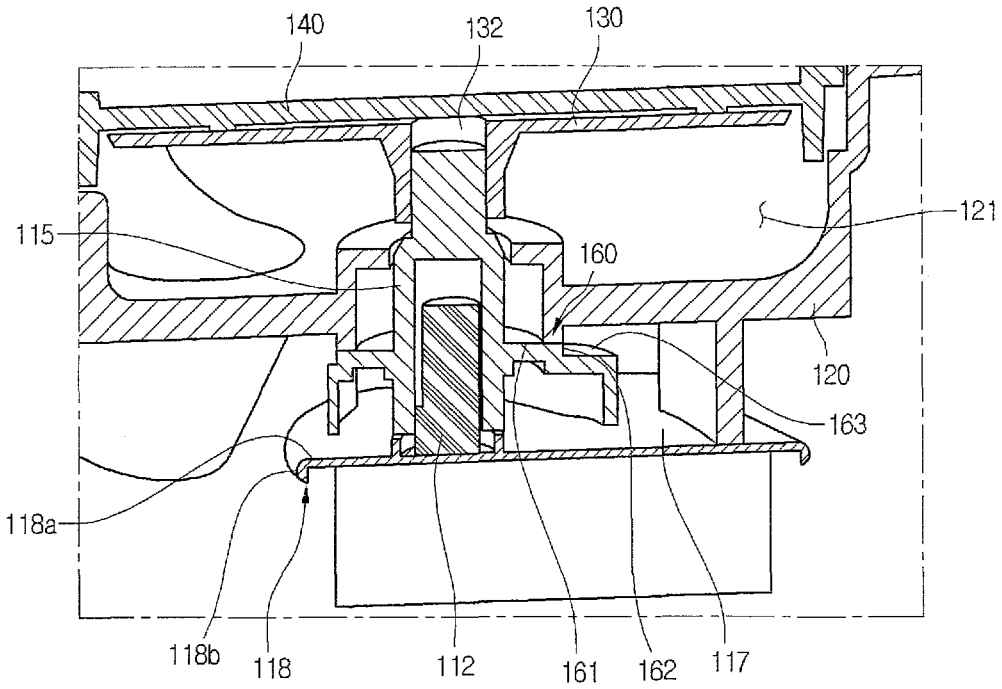
FIG. 11 is a cross-sectional view illustrating introduction preventing parts according to a third embodiment.

FIG. 11 is a cross-sectional view illustrating introduction preventing parts according to a third embodiment.

Referring to FIG. 11, according to the third embodiment, the passage opening-closing part 100 includes introduction preventing parts 160 and 118 that prevent washing water stored or moved in the storage case 120 from being introduced to the opening-closing driving part 110.

In detail, the introduction preventing parts 160 and 118 include a first introduction preventing part (also denoted by 160) extending outward from the shaft connection 115, and a second introduction preventing part (also denoted by 118) disposed on a top 117 of the opening-closing driving part 110.

The first introduction preventing part 160 includes a first extension 161 extending outward from the outer circumferential surface of the shaft connection 115, a stepped part 162 extending downward from the first extension 161, and a second extension 163 extending outward from the stepped part 162. That is, the first introduction preventing part 160 extends outward in a stepped shape.

Accordingly, even when washing water leaks along the shaft connection 115 from the storage case 120, the washing water can be guided outward by the first introduction preventing part 160. As a result, the washing water is prevented from being introduced into the driving shaft 112.

The second introduction preventing part 118 includes an extension 118*a* extending outward from the outer circumferential surface of the top 117, and a bent portion 118*b* bent downward from the extension 118*a*. The top 117 constitutes the top of the opening-closing driving part 110.

Accordingly, even when washing water leaks along the top 117, since the washing water is guided outward and downward along the second introduction preventing part 118, the washing water is prevented from being introduced into the opening-closing driving part 110 or the driving shaft 112. The second introduction preventing part 118 may function as eaves for the opening-closing driving part 110. As a result, leaking washing water is prevented from being introduced into the opening-closing driving part 110.

Figure 12:
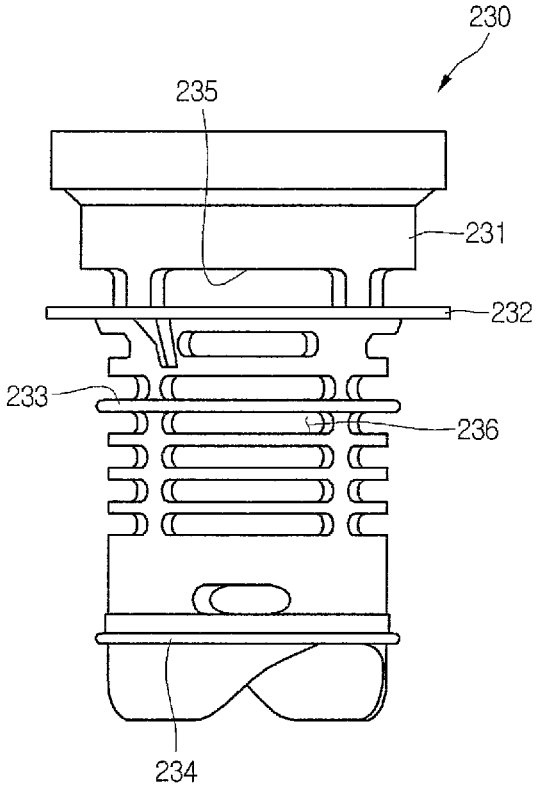
FIG. 12 is a side view illustrating a first filter according to a fourth embodiment.
Figure 13:
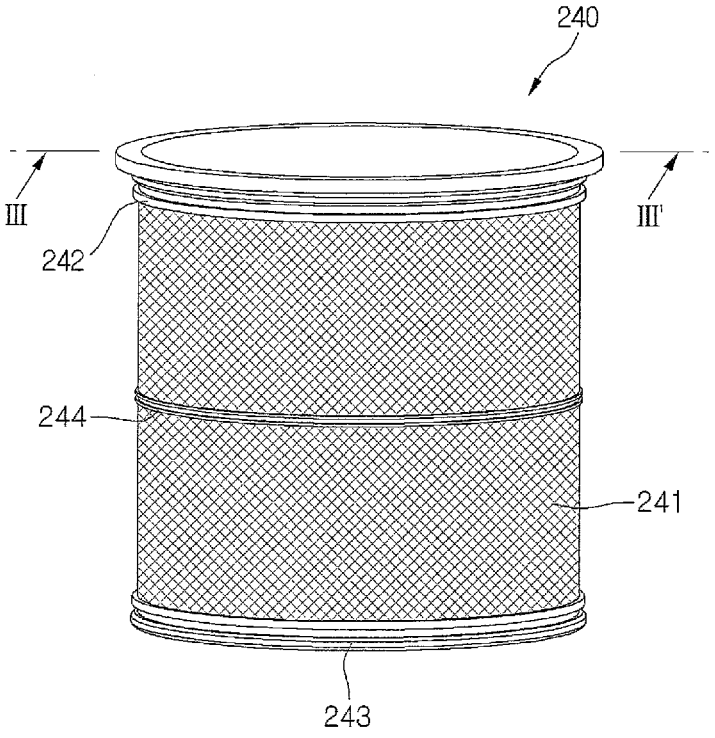
FIG. 13 is a perspective view illustrating a second filter according to the fourth embodiment.
Figure 14:
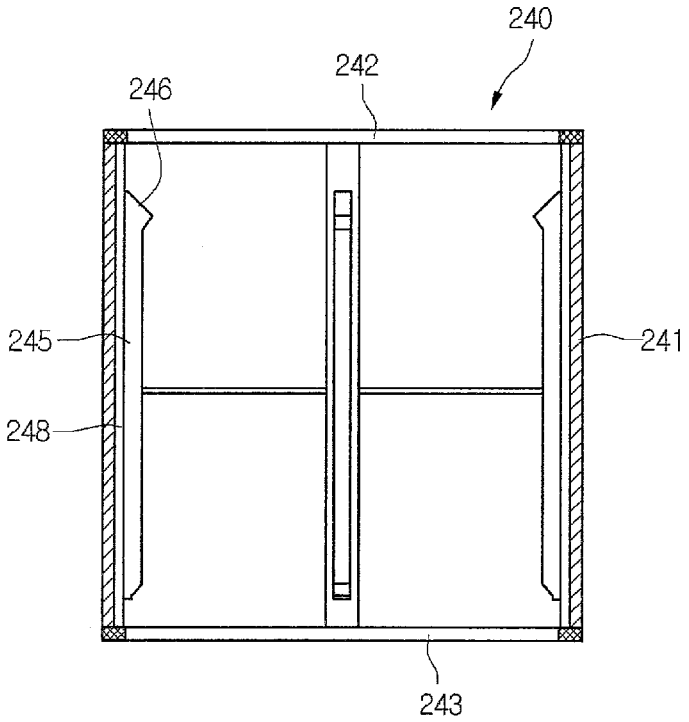
FIG. 14 is a cross-sectional view taken along line of FIG. 13.

FIG. 12 is a side view illustrating a first filter according to a fourth embodiment. FIG. 13 is a perspective view illustrating a second filter according to the fourth embodiment. FIG. 14 is a cross-sectional view taken along line III-III' of FIG. 13.

Referring to FIGS. 12 to 14, a filter assembly according to the current embodiment includes a first filter 230 and a second filter 240. The filter assembly may be removably coupled to the filter housing 210.

In detail, the first filter 230 includes a filter main body 231 having a filter introduction part 235.

The filter introduction part 235 is disposed in the upper portion of the filter main body 231, and washing water recovered from the tub 11 to the sump 20 may be introduced into the filter main body 231 through the filter introduction part 235. The filter main body 231 is provided with filter holes 236 for filtering a foreign substance. A foreign substance having a large volume is filtered by the filter holes 236, and is deposited in the filter main body 231.

The filter main body 231 is provided with ribs 233 and 234 coupled to the second filter 240. The ribs 233 and 234 include an upper rib (also denoted by 233) disposed in the upper portion of the filter main body 231, and a lower rib (also denoted by 234) spaced downward from the upper rib 233. The upper rib 233 and the low rib 234 may be referred to as a first rib and a second rib, respectively.

The upper rib 233 is disposed under the filter introduction part 235, and has a ring shape along an outer circumferential surface of the filter main body 231. That is, the upper rib 233 protrudes a predetermined length from the outer circumferential surface of the filter main body 231.

The lower rib 234 is spaced upward from the lower end of the filter main body 231, and has a ring shape along the outer circumferential surface of the filter main body 231. The lower rib 234 and the upper rib 233 may have the same diameter.

A limiting rib 232 is disposed over the upper rib 233 to limit an upper movement of the second filter 240 coupled to the first filter 230. The limiting rib 232 has a ring shape protruding outward from the outer circumferential surface of the filter main body 231. The diameter of the limiting rib 232 may be greater than the diameter of the upper rib 233 and the lower rib 234. When the upper end of the second filter 240 contacts the limiting rib 232, an upward movement of the second filter 240 is stopped.

The second filter 240 includes: a filter surface 241 having fine filter holes; and a plurality of frames 242, 243, and 244, which are provided to the filter surface 241. The filter holes of the filter surface 241 may be smaller than the filter holes 236 of the first filter 230.

The frames 242, 243, and 244 may function as supporting frames for supporting the filter surface 241, and have a ring shape surrounding the filter surface 241. The frames 242, 243, and 244 include a top frame (also denoted by 242) provided to the upper end of the filter surface 241, a bottom frame (also denoted by 243) provided to the lower end of the filter surface 241, and a fixing frame 244 provided to the middle portion of the filter surface 241.

The filter surface 241 is provided with a coupling guide 245 and a guide support 248 at the inside thereof. The coupling guide 245 couples the second filter 240 to the first filter 230. The guide support 248 fixes the coupling guide 245 to the filter surface 241. The coupling guide 245 may be provided in plurality, and the guide support 248 may be provided in plurality. The guide supports 248 are disposed between the filter surface 241 and the coupling guides 245.

Catching hooks 246 are disposed at ends of the coupling guides 245 to catch the upper rib 233 or the lower rib 234. Referring to FIG. 14, a position where the second filter 240 is disposed in a first direction such that the ends of the coupling guides 245 provided with the catching hooks 246 are at the upper side is defined as a first position.

On the contrary, a position where the second filter 240 is disposed in a second direction such that the ends of the coupling guides 245 provided with the catching hooks 246 are at the lower side is defined as a second position. In this case, the first direction may be opposite to the second direction.

Figure 15:
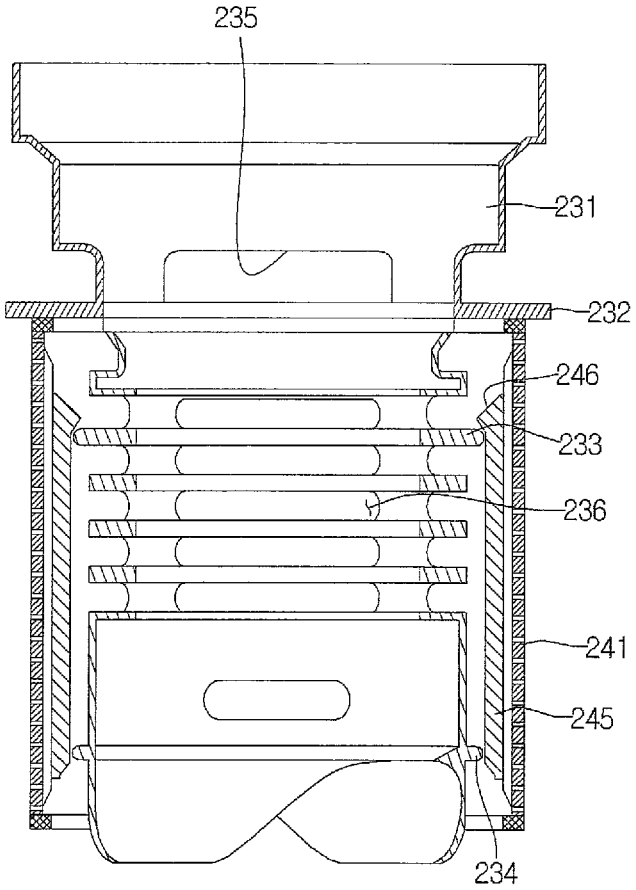
FIG. 15 is a cross-sectional view illustrating a filter assembly assembled in a first direction according to the fourth embodiment.
Figure 16:
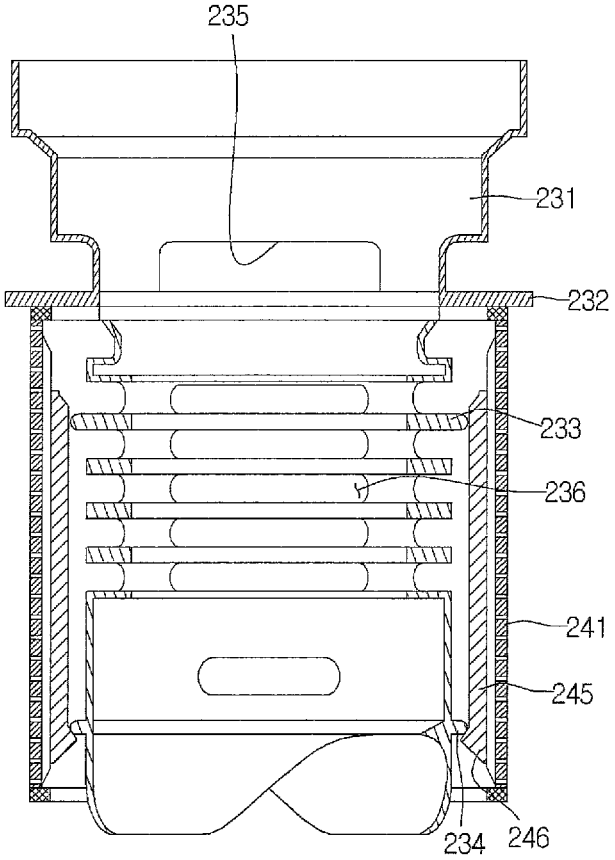
FIG. 16 is a cross-sectional view illustrating the filter assembly assembled in a second direction according to the fourth embodiment.

FIG. 15 is a cross-sectional view illustrating a filter assembly assembled in a first direction according to the fourth embodiment. FIG. 16 is a cross-sectional view illustrating the filter assembly assembled in a second direction according to the fourth embodiment.

Referring to FIGS. 15 and 16, the second filter 240 may be coupled to the outer portion of the first filter 230 in different directions.

In detail, referring to FIG. 15, the second filter 240 disposed at the first position is coupled to the outer portion of the first filter 230.

The second filter 240 disposed at the first position may be coupled to the outer portion of the first filter 230 from the lower side of the first filter 230 to the upper side thereof. The second filter 240 may be moved upward until the catching hooks 246 catch the upper rib 233. When the catching hooks 246 catch the upper rib 233, a user can hear the first filter 230 is coupled to the second filter 240.

Even when the second filter 240 is pushed up after the first filter 230 is coupled to the second filter 240, since the second filter 240 contacts the limiting rib 232, the second filter 240 is prevented from being removed upward from the first filter 230.

Referring to FIG. 16, the second filter 240 disposed at the second position is coupled to the outer portion of the first filter 230.

The second filter 240 disposed at the second position may be coupled to the outer portion of the first filter 230 from the lower side of the first filter 230 to the upper side thereof. The second filter 240 may be moved upward until the catching hooks 146 catch the lower rib 234.

Since the upper rib 233 and the lower rib 234 are caught by the catching hooks 246, the upper rib 233 and the lower rib 234 may be referred to as a first stopper and a second stopper, respectively, to correspond to the catching hooks 246.

When the catching hooks 246 catch the lower rib 234, a user can hear the first filter 230 is coupled to the second filter 240. Even when the second filter 240 is pushed up after the first filter 230 is coupled to the second filter 240, since the second filter 240 contacts the limiting rib 232, the second filter 240 is prevented from being removed upward from the first filter 230.

As such, the second filter 240 may be coupled to the first filter 230 at a standing position, e.g., at the first position or an upright position, or be coupled to the first filter 230 at an upside down position, e.g., the second position or a reverse position. Thus, the second filter 240 can be coupled to the first filter 230 from the lower side of the first filter 230 to the upper side thereof, without checking a coupling direction of the second filter 240, thereby improving convenience for a user.

Another embodiment will now be described.

According to the previous embodiment, the upper rib 233 and the lower rib 234 are provided to the first filter 230, and the catching hooks 246 are provided to the second filter 240.

Alternatively, according to the current embodiment, catching hooks may be provided to the first filter 230, and ribs may be provided to the second filter 240. In this case, the catching hooks and coupling guides are provided to the outer circumferential surface of the first filter 230, and the ribs (upper and lower ribs) are provided to the inner circumferential surface of the second filter 240.

Accordingly, the catching hooks can be selectively coupled to the upper or lower rib according to a coupling direction of the second filter 240. As a result, the filter assembly, that is, the first filter 230 and the second filter 240 can be conveniently assembled, regardless of a coupling direction of the second filter 240.

According to the embodiments, since the impeller part is connected directly to the lower portion of the washing water motor, the entire height of the sump can be decreased. In addition, since the volume of the sump is decreased, the length of the passages for washing water within the sump, and the amount of circulating washing water are decreased.

In addition, since the air gap is disposed between the top of the impeller part and the impeller case, a contact area of washing water with the shaft housing or the sealing member can be decreased, and thus, the shaft housing or the sealing member can be protected.

In addition, since the opening-closing valve can be vertically moved, a foreign substance can be prevented from being trapped between the opening-closing valve and the valve case.

In addition, since a foreign substance is prevented from interfering with an operation of the opening-closing valve of the passage opening-closing part, a passage can be efficiently controlled, and a noise due to a foreign substance can be reduced. In addition, since the passage opening-closing part is protected from a foreign substance, its reliability is improved.

In addition, since the contact rib for decreasing frictional force is disposed between the opening-closing valve and the valve case, the opening-closing valve can be efficiently operated. In addition, since the introduction preventing part is disposed between the opening-closing valve and the driving motor, washing water flowing within the opening-closing valve is prevented from being introduced to the driving motor or its inner terminal.

In addition, the filter assembly including the filters can be efficiently assembled. Particularly, since the filters can be coupled to each other regardless of a coupling direction one of the filters, convenience for a user is improved. In addition, since the filters can be efficiently coupled to each other after being cleaned, sanitation and convenience for a user are improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a washing chamber accommodating a dish;

a sump including a housing for storing washing water supplied to the washing chamber; and a washing water pump provided outside of the housing and generating suction force for circulating washing water; and a pump introduction part extending from the housing towards the washing water pump to allow a flow of the washing water discharged from the housing to the washing water pump, wherein the washing water pump includes:

a pump housing connected with the pump introduction part and having a heating space;

a washing water motor disposed in the pump housing for generating driving force;

a motor case accommodating the washing water motor;

an impeller part disposed under the washing water motor and rotated by the driving force;

a motor shaft connecting the washing water motor to the impeller part; and a heater disposed in the heating space to heat washing water, wherein the heating space is formed at a lower side of the impeller part.

2. The dishwasher according to claim 1, further comprising;

a shaft housing disposed between the washing water motor and the impeller part to receive at least a portion of the motor shaft; and a sealing member disposed in the shaft housing to prevent a flow of washing water from the impeller part to the washing water motor.

3. The dishwasher according to claim 1, further comprising:

a storage case provided to the sump and storing washing water to be supplied to the washing chamber;

a valve rotatably disposed at a side of the storage case; and a valve case allowed to contact a top of the valve, wherein the valve is allowed to move to a lower side of the valve case according to whether washing water flows or not.

4. The dishwasher according to claim 3, further comprising:

an driving part for providing driving force to the valve, and including a driving shaft; and a shaft connection for transmitting torque from the driving shaft to the valve, and including a stepped part.

5. The dishwasher according to claim 4, wherein the valve is movable from a position where the valve contacts the valve case, to a position where the valve contacts an upper portion of the stepped part.

6. The dishwasher according to claim 3, wherein the valve case comprises:

a case main body corresponding to the valve; and a contact rib protruding from the case main body, and contacting the valve.

7. The dishwasher according to claim 6, wherein the contact rib is disposed to correspond to a radius of gyration of the valve.

8. The dishwasher according to claim 4, further comprising an introduction preventing part that extends in a stepped shape outward from the shaft connection or the driving part, and prevents introduction of washing water to the driving part.

9. The dishwasher according to claim 1, further comprising a filter assembly that is provided to the sump, and filters a foreign substance from washing water, wherein the filter assembly includes:

a first filter including a filter hole having a certain size, and a plurality of ribs; and a second filter that includes a filter surface having a filter hole smaller than the filter hole of the first filter, is coupled to an outer portion of the first filter, and is provided with a catching hook catching one of the plurality of ribs according to a coupling direction.

10. The dishwasher according to claim 9, wherein, when the second filter is coupled to the first filter at a first position, the catching hook is coupled to a first one of the plurality of ribs, and when the second filter is coupled to the first filter at a second position, the catching hook is coupled to a second one of the plurality of ribs.

11. The dishwasher according to claim 1, further comprising a shaft housing disposed between the washing water motor and the impeller part to receive at least a portion of the motor shaft.

12. The dishwasher according to claim 11, wherein an upper end of the shaft housing is disposed at a position corresponding to the lower end of the motor case and a lower end of the shaft housing is disposed at a position corresponding to an upper end of the impeller part.

13. The dishwasher according to claim 11, further comprising an impeller case disposed outside the shaft housing and including an extension that laterally extends from an outer circumferential surface of the shaft housing and a bent portion that extends downward from the extension.

14. The dishwasher according to claim 13, further comprising an air gap defined by the impeller part, the extension and the bent portion of the impeller case and the shaft housing, to accommodate air.

15. The dishwasher according to claim 11, wherein a height of the washing water pump is determined by a sum of heights of the motor case, the shaft housing, the impeller part, and the heating space.

16. The dishwasher according to claim 11, wherein the motor case contacts an upper portion of the shaft housing.

17. A dishwasher comprising:

a washing chamber accommodating a dish;

a sump for storing washing water supplied to the washing chamber; and a washing water pump provided to the sump and generating suction force for circulating washing water, wherein the washing water pump includes:

a washing water motor;

a motor case accommodating the washing water motor;

a motor shaft passing through the washing water motor to extend downward from the washing water motor;

a shaft housing accommodating at least one portion of the motor shaft and having an inner circumferential surface being spaced apart from an outer circumferential surface of the motor shaft;

an impeller part rotatably coupled to a lower end of the shaft housing, wherein an upper end of the shaft housing is disposed at a position corresponding to a lower end of the motor case and a lower end of the shaft housing is disposed at a position corresponding to an upper end of the impeller part;

a heating space disposed under the impeller part, and provided with a heater; and a sealing member disposed at a lower part of the shaft housing and extending from the outer circumferential surface of the motor shaft to the inner circumferential surface of the shaft housing to prevent washing water passing through the impeller part from being introduced into the shaft housing.

18. The dishwasher according to claim 17, wherein the washing water motor contacts the shaft housing.

19. The dishwasher according to claim 17, further comprising an impeller case that extends at least in one direction from the shaft housing, and covers an upper portion of the impeller part, wherein an air gap is defined by the shaft housing, the impeller case, and the impeller part.

20. The dishwasher according to claim 19, wherein the impeller case comprises:

an extension part spaced apart from the lower end of the shaft housing by a preset distance; and a bent portion bent downward from an end of the extension.

21. The dishwasher according to claim 17, further comprising:

a storage case to which washing water is introduced via the washing water pump;

an valve provided to the storage case, and including a valve hole through which washing water flows;

a motor providing the valve with driving force;

a valve case including a case hole allowed to communicate with the valve hole; and a shaft connection transmitting the driving force from the motor to the opening-closing valve, wherein the valve is vertically movable between a first position and a second position along the shaft connection.

22. The dishwasher according to claim 21, wherein the valve contacts the valve case at the first position, and the valve is hung on the shaft connection at the second position.

23. The dishwasher according to claim 21, wherein, when the washing water pump is driven, the valve is disposed at the first position, and when the washing water pump is turned off, the valve is disposed at the second position.

24. The dishwasher according to claim 21, wherein the valve case comprises a contact rib on a surface thereof, the contact rib is defined as a region that the valve contacts, and the contact rib includes:

a first rib disposed to correspond to a radius of gyration of the valve; and a second rib extending along a circumference of the case hole.

25. The dishwasher according to claim 17, further comprising:

a first filter provided to the sump, and filtering a foreign substance from washing water;

a second filter coupled to an outer portion of the first filter, and filtering a foreign substance from the washing water purified by the first filter;

a plurality of stoppers provided to one of the first filter and the second filter; and a catching hook provided to the other of the first filter and the second filter, and catching one of the stoppers, wherein the second filter is coupled to the first filter at a standing position in a first direction and at a standing position in a second direction.

26. The dishwasher according to claim 25, wherein the first direction is an upright direction of the second filter, and the second direction is a reverse direction of the second filter.

* * * * *